US008340966B2

(12) United States Patent
Kerimovska et al.

(10) Patent No.: US 8,340,966 B2
(45) Date of Patent: Dec. 25, 2012

(54) DEVICE FOR GENERATING SPEECH, APPARATUS CONNECTABLE TO OR INCORPORATING SUCH A DEVICE, AND COMPUTER PROGRAM PRODUCT THEREFOR

(75) Inventors: Nercivan Kerimovska, Malmo (SE); Gunnar Klinghult, Lund (SE); Anna Tomasson, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 317 days.

(21) Appl. No.: 10/539,238

(22) PCT Filed: Nov. 14, 2003

(86) PCT No.: PCT/EP03/12879

§ 371 (c)(1),
(2), (4) Date: Apr. 10, 2006

(87) PCT Pub. No.: WO2004/055779

PCT Pub. Date: Jul. 1, 2004

(65) Prior Publication Data

US 2006/0217981 A1 Sep. 28, 2006

Related U.S. Application Data

(60) Provisional application No. 60/474,025, filed on May 29, 2003.

(30) Foreign Application Priority Data

Dec. 16, 2002 (EP) ..... 02445177
May 22, 2003 (EP) ..... 03011580

(51) Int. Cl.
*G10L 13/08* (2006.01)

(52) U.S. Cl. ..... 704/260; 715/200; 709/206; 704/275; 704/251; 704/235; 455/90.1; 455/575.5; 455/575.3; 455/575.1; 455/566; 455/556.2; 455/550.1; 455/406; 455/405; 380/270; 379/93.01; 379/433.02; 379/110.01; 345/169; 235/462.25

(58) Field of Classification Search ..... 704/271, 704/275, 260, 251, 235; 455/90.1, 566, 575.5, 455/575.3, 575.1, 556.2, 550.1, 406, 405; 380/270; 709/206; 715/200; 379/93.01, 379/433.02, 110.01; 345/169; 235/462.25
See application file for complete search history.

(56) References Cited

U.S. PATENT DOCUMENTS 5,357,596 A * 10/1994 Takebayashi et al. ..... 704/275

(Continued)

FOREIGN PATENT DOCUMENTS

EP 0776097 5/1997

(Continued)

OTHER PUBLICATIONS

S. Lemmetty "Review of Speech Synthesis Technology", Master's Thesis, Helsinki University of Tech., Dept. of Electrical and Comm. Eng., pp. 1-104 (1999).

(Continued)

*Primary Examiner* — Michael Colucci
(74) *Attorney, Agent, or Firm* — Myers Bigel Sibley & Sajovec, P.A.

(57) ABSTRACT

A control unit extracts at least a part of data that is displayed on a display and sends the extracted part of the displayed data to a speech generating device. The speech generating device includes a conversion circuit that converts the received data to a speech signal. The conversion circuit may be connected to a speaker system for broadcasting the speech signal.

36 Claims, 1 Drawing Sheet

U.S. PATENT DOCUMENTS

| | | | | |
|---|---|---|---|---|
| 5,479,479 | A * | 12/1995 | Braitberg et al. | 455/404.1 |
| 5,526,411 | A * | 6/1996 | Krieter | 379/110.01 |
| 5,687,717 | A * | 11/1997 | Halpern et al. | 600/300 |
| 5,819,162 | A * | 10/1998 | Spann et al. | 455/575.5 |
| 5,848,133 | A * | 12/1998 | Kuwahara et al. | 379/93.01 |
| 5,881,149 | A * | 3/1999 | Weatherill | 379/433.02 |
| 6,012,028 | A | 1/2000 | Kubota et al. | |
| 6,145,101 | A * | 11/2000 | Pike | 714/46 |
| 6,167,251 | A * | 12/2000 | Segal et al. | 455/406 |
| 6,226,615 | B1 * | 5/2001 | Kirby et al. | 704/272 |
| 6,434,403 | B1 * | 8/2002 | Ausems et al. | 455/556.2 |
| 6,463,263 | B1 * | 10/2002 | Feilner et al. | 455/90.1 |
| 6,509,907 | B1 * | 1/2003 | Kuwabara | 345/684 |
| 6,701,162 | B1 * | 3/2004 | Everett | 455/556.1 |
| 6,836,651 | B2 * | 12/2004 | Segal et al. | 455/405 |
| 6,895,316 | B2 * | 5/2005 | Chen et al. | 701/36 |
| 6,996,530 | B2 * | 2/2006 | Shizuka et al. | 704/260 |
| 7,035,803 | B1 * | 4/2006 | Ostermann et al. | 704/260 |
| 7,043,436 | B1 * | 5/2006 | Ryu | 704/270.1 |
| 7,047,052 | B2 * | 5/2006 | Akai et al. | 455/575.1 |
| 7,124,167 | B1 * | 10/2006 | Bellotti et al. | 709/206 |
| 7,305,342 | B2 * | 12/2007 | Shizuka et al. | 704/260 |
| 7,853,863 | B2 * | 12/2010 | Sakai | 715/200 |
| 2001/0014860 | A1 * | 8/2001 | Kivimaki | 704/260 |
| 2001/0035459 | A1 * | 11/2001 | Komai | 235/462.25 |
| 2002/0006806 | A1 * | 1/2002 | Kinnunen et al. | 455/550 |
| 2002/0022503 | A1 * | 2/2002 | Lee | 455/566 |
| 2002/0034956 | A1 | 3/2002 | Mekuria | |
| 2002/0044136 | A1 * | 4/2002 | Griffin et al. | 345/169 |
| 2002/0118800 | A1 * | 8/2002 | Martinez et al. | 379/67.1 |
| 2002/0143534 | A1 | 10/2002 | Hol | |
| 2002/0159600 | A1 * | 10/2002 | Weiner | 380/270 |
| 2002/0186251 | A1 * | 12/2002 | Himmel et al. | 345/784 |
| 2003/0009342 | A1 * | 1/2003 | Haley | 704/276 |
| 2003/0028380 | A1 * | 2/2003 | Freeland et al. | 704/260 |
| 2003/0078775 | A1 * | 4/2003 | Plude et al. | 704/235 |
| 2004/0049388 | A1 * | 3/2004 | Roth et al. | 704/251 |
| 2004/0128129 | A1 * | 7/2004 | Sherman | 704/235 |
| 2004/0185919 | A1 * | 9/2004 | Yoo | 455/575.1 |
| 2005/0250562 | A1 * | 11/2005 | Carroll | 455/575.3 |
| 2008/0045274 | A1 * | 2/2008 | Witkowski et al. | 455/569.2 |

FOREIGN PATENT DOCUMENTS

| | | | |
|---|---|---|---|
| TW | 135967 | | 6/1990 |
| TW | 330268 | | 4/1998 |
| TW | 434492 | B | 5/2001 |
| TW | 469421 | B | 12/2001 |
| TW | 305990 | Y | 2/2007 |
| WO | WO 0157851 | | 8/2001 |
| WO | WO 02069320 | | 9/2002 |

OTHER PUBLICATIONS

Gros et al. "The Phonectic SMS Reader", Springer-Verlag Berlin Heidelberg pp. 334-340 (2001).

Smith M. et. al; "FlexVoice Disp—Text to Speech Distributed Speech Processing", White Paper, MindMaker Inc., (Feb. 6, 2002) XP 002262275.

International Preliminary Examination Report for PCT/EP03/12879.

International Search Report for PCT/EP03/12879.

Taiwanese Office Action and English Translation (11 pages) corresponding to Taiwanese Patent Application No. 092133350; Issue Date: Oct. 27, 2008.

Winbond, "Products & Technology: Winbond Offers Text-To-Speech Customers New Reference Design", http://winbond.com/hq/enu/NewsAndEvents/News/ProductAndTechnology/2002-01-22.html, 6 pages (Jan. 22, 2002).

* cited by examiner

DEVICE FOR GENERATING SPEECH, APPARATUS CONNECTABLE TO OR INCORPORATING SUCH A DEVICE, AND COMPUTER PROGRAM PRODUCT THEREFOR

RELATED APPLICATIONS

The present application is a 35 U.S.C. §371 national phase application of PCT International Application No. PCT/EP2003/012879, having an international filing date of Nov. 14, 2003 and claiming priority to European Patent Application No. 02445177.5, filed Dec. 16, 2002, European Patent Application No. 03011580.2, filed May 22, 2003, and U.S. Provisional Application No. 60/474,025 filed May 29, 2003, the disclosures of which are incorporated herein by reference in their entireties. The above PCT International Application was published in the English language and has International Publication No. WO 2004/055779.

FIELD OF THE INVENTION

The present invention relates to electronic devices, and more particularly, to devices for generating speech associated with information shown on a display.

BACKGROUND OF THE INVENTION

In portable devices, such as mobile telephones etc., the displays may be used to display menus controlling the operation and settings of the device or other information relating to messages or games. The displays are often small, which may be a problem for the user, especially if he is visually impaired. Also for other reasons, there may be a need for an audible version of the display.

SUMMARY OF THE INVENTION

In a first aspect, the invention provides a device for generating speech, wherein a microcontroller is connectable to an apparatus for receiving data to be converted to speech, and sending the data to a conversion circuit; and a conversion circuit connectable to a speaker system for converting the data to a speech signal.

Preferably, the data is supplied as ASCII characters.

Suitably, the conversion circuit supports various selectable languages and the conversion circuit is capable of downloading languages via the connected apparatus.

Suitably, the conversion circuit supports various selectable voices and the conversion circuit is capable of downloading voices via the connected apparatus.

Preferably, the speed of the speech signal is adjustable.

Preferably, the microcontroller is connectable to a memory containing language information, such as various languages, abbreviation lists and dictionaries.

Preferably, the microcontroller is connectable to a memory containing voice settings.

Suitably, the microcontroller is connectable to the apparatus by means of a system connector having an interface for audio signals, serial channels, power leads and analog and digital ground leads.

The device may be implemented as a functional cover, comprising a shell covering the front of the apparatus and a microprocessor cooperating with the processor of the apparatus.

The connectable apparatus may be a portable telephone, a pager, a communicator or an electronic organiser.

In a second aspect, the invention provides an apparatus having a display for showing various readable data, wherein a control unit is arranged to extract readable data for sending to a device for generating speech as mentioned above.

The readable data may include texts from menus, text messages, help information, calendars or confirmation of actions taken with the apparatus.

Suitably, the control unit is arranged to extract a part of the readable data, such as a line or a word, at a time from the display and sending it automatically to the speech generating device at a fixed or controllable rate, and/or the control unit is arranged to extract a line at a time from the display and sending it to the speech generating device in dependence of scrolling in the display.

Suitably, the control unit is also arranged to extract a part of the readable data, such as a character, a line or a word, at a time from the display and sending it to the speech generating device in dependence of inputting characters to the apparatus.

Then, the control unit may be arranged to send readable data as triggered by the input of definite characters, such as letters, signs, spaces or punctuation marks.

Preferably, the control unit is arranged to extract readable data from a selected file and sending it automatically to the speech generating device at a fixed or controllable rate.

In a third aspect, the invention provides an apparatus having a display for showing various readable data, including a control unit and a device for generating speech comprising a conversion circuit for converting data to a speech signal and connectable to a speaker system, wherein the control unit is arranged to extract readable data for sending to the speech generating device.

The speaker system may be integrated with the apparatus.

Suitably, the data is supplied as ASCII characters.

Suitably, the conversion circuit supports various selectable languages, and is capable of downloading languages.

Suitably, the conversion circuit supports various selectable voices, and is capable of downloading voices.

Preferably, the speed of the speech signal is adjustable.

Suitably, the apparatus is connectable to a memory containing language information, such as various languages, abbreviation lists and dictionaries.

Suitably, the apparatus is connectable to a memory containing voice settings.

Preferably, the readable data includes texts from menus, text messages, help information, calendars or confirmation of actions taken with the apparatus.

Suitably, the control unit is arranged to extract a part of the readable data, such as a line or a word, at a time from the display and sending it automatically to the speech generating device at a fixed or controllable rate, and/or the control unit is arranged to extract a line at a time from the display and sending it to the speech generating device in dependence of scrolling in the display.

Suitably, the control unit is arranged to extract a part of the readable data, such as a character, a line or a word, at a time from the display and sending it to the speech generating device in dependence of inputting characters to the apparatus.

Then, the control unit may be arranged to send readable data as triggered by the input of definite characters, such as letters, signs, spaces or punctuation marks.

Preferably, the control unit is arranged to extract readable data from a selected file and sending it automatically to the speech generating device at a fixed or controllable rate.

The apparatus may be a portable telephone, a pager, a communicator or an electronic organiser.

In a fourth aspect, the invention provides a computer program product loadable into the internal memory of an apparatus having a display for showing various readable data, wherein the computer program product comprises software code portions to achieve the functionality of the apparatus as mentioned above.

The computer program product may be embodied on a computer readable medium.

BRIEF DESCRIPTION OF THE DRAWINGS

Embodiments of the invention will be described in detail below with reference to the accompanying drawings, of which.

DETAILED DESCRIPTION OF PREFERRED EMBODIMENTS

The invention will be described in relation to a mobile phone including text-to-speech conversion. The invention is also applicable in many other devices, e.g. pagers, communicators, electronic organisers and the like portable devices.

Text-to-speech conversion is a feature that is of interest in many different areas and applications. One of the more interesting is the use in mobile phones. Today mobile phones are used by almost everyone and a feature like this can be an important aid, especially for the visually impaired and for users who need to focus on other things while using the phone, for instance car drivers using hands-free equipment. The text-to-speech conversion is done in hardware with a text-to-speech circuit. A highlighted menu label, an SMS or other readable data are sent to a microcontroller. The data may be received as ASCII characters and these are forwarded to the text-to-speech circuit by the microcontroller. The text-to-speech circuit converts the characters to audio signals and sends them to a loudspeaker system.

The invention makes the mobile telephone more user-friendly by reading messages and menus to help the user locate himself while browsing the menus system.

Figure 1:
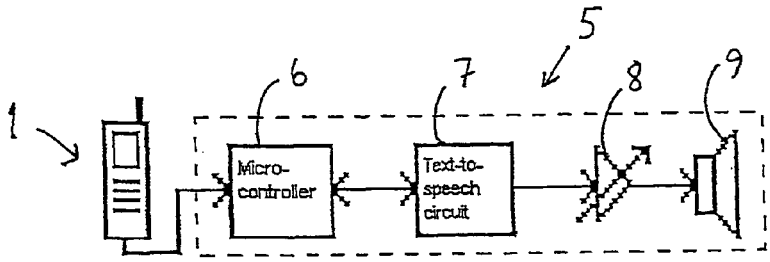
FIG. 1 is a block diagram of the main blocks of the invention.

FIG. 1 shows an embodiment of the invention in which the speech generating device is implemented as an accessory. The accessory is to be attached to a mobile phone 1 via its system connector. The accessory may be implemented as a so called active or functional cover, that is a shell covering e.g. the front of the phone and also connected to the phone's system connector. The functional cover contains a microprocessor holding additional functions and cooperating with the processor of the telephone. Thus, the actual outer shape of the accessory depends on the mobile phone and is not shown here.

The speech generating device 5 is shown within the dashed square and includes a microcontroller 6 receiving the data to be converted from the mobile phone and passing it to a text-to-speech (TTS) circuit 7. The TTS circuit 7 converts the text to audio signals and sends them via an (optional) amplifier 8 to a loudspeaker 9.

Figure 4:
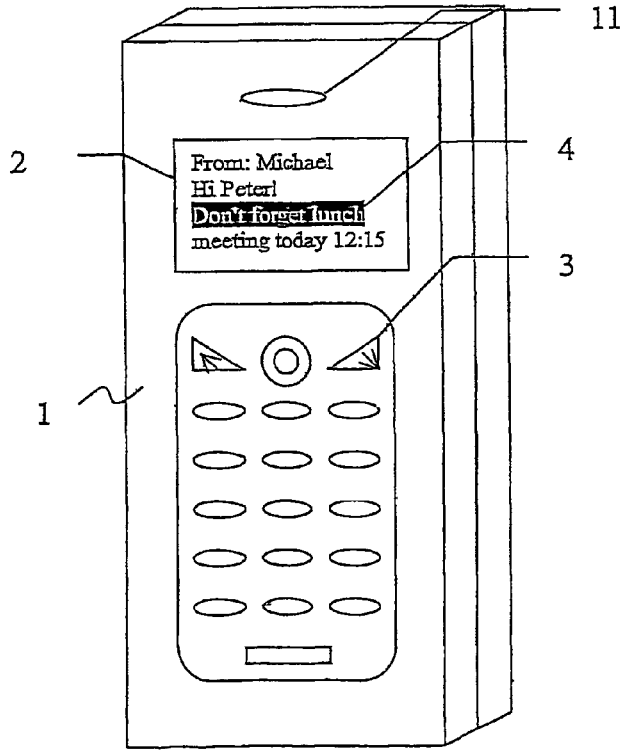
FIG. 4 is an example of a mobile phone using the present invention.

In another embodiment, the speech generating device is built into the mobile phone and may use the internal hardware, software and speaker system 11, see FIG. 4. Existing telephones are usually provided with a microprocessor and a digital signal processor capable of being programmed to perform the required text to speech conversion. Thus, the text to speech conversion may be embodied as a software product, e.g. a computer program on a readable medium or deliverable through the Internet.

The microcontroller may for example be a commercially available circuit comprising a programmable flash memory, general purpose input/output lines and working registers, internal and external interrupts, a programmable serial universal asynchronous receiver and transmitter (UART) and a port for a serial peripheral interface. The registers are programmed to control the behaviour of the microcontroller in the desired way. The microcontroller is responsible for receiving the data to be converted to speech and sending the data to the TTS circuit.

The TTS circuit 7 may be a commercially available circuit. The circuit should have an output designed to drive a speaker, and preferably also a telesocket for headphone or an external loudspeaker. To get a higher volume a general amplifier 8 could be used, e.g. a fully differential audio power amplifier.

The TTS circuit should also support SMS (Short Message Service) and preferably a modifiable abbreviation list. The TTS circuit also should support various languages. In a preferred embodiment it is possible to program other languages through a serial port allowing the user to download different languages. A standard speaker voice is built-in, but preferably it is also possible to download different speaker voices or connect external memories, for instance so called memory sticks, containing voice data. When the speech generating device is connected or integrated in a mobile phone or communicator, databases could be downloaded via the telecommunication network or the Internet.

The TTS circuit receives data to be read through its input port, e.g. ASCII characters, converts it into spoken audio and sends it to an analog output. A typical circuit comprises a text processor, a smoothing filter and multilevel memory storage array. The voice and audio signals are stored in the memory in their natural, uncompressed form, which provides a good voice reproduction quality.

The speech conversion is conventional and is not described in detail here. Briefly, the text-to-speech mechanism comprises text normalisation, word to phoneme conversion and phoneme mapping. The text normalisation is the process of translating the incoming text to pronounceable words. It expands abbreviations and translates numeric strings to spoken words. The abbreviation list can be modified. This enables flexibility of adding abbreviations specifically for the text, either by the developer or by the end user to customise the device. Even the unique characters of SMS are supported, meaning that icons such as smilies ;-) will be replaced by its corresponding true spoken meaning. This means that an SMS containing abbreviations and icons will be correctly recited.

The TTS circuit should have an internal input buffer that could hold at least 256 characters in order to receive an entire SMS consisting of 160 characters. This means that no extra memory is needed in the connecting apparatus.

The microcontroller 6 preferably is connected to a volume control to adjust the volume of a speaker system connected. For instance, two buttons could be provided, one to increase the volume and one to decrease the volume. The buttons are suitably connected to the interrupt pins of the microcontroller.

Figure 2:
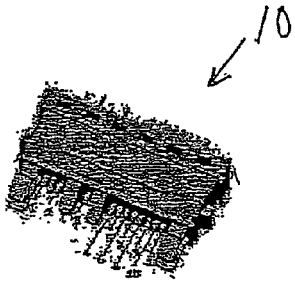
FIG. 2 is a perspective view of a system connector.

The speech generating device is provided with an interface for connecting the device to the phone via its system connector. The system connector interface comprises audio signals, two serial channels, power leads and the analog and digital ground leads. A typical system connector interface 10 is shown in FIG. 2.

The mobile telephone is arranged to extract texts and characters from the data shown on the display and to send it to the speech generating device. The extracted text string may be sent to the device to place the data on the system bus. All text strings are stored in a list and a text ID is a pointer used to point out the different text strings.

Figure 3:
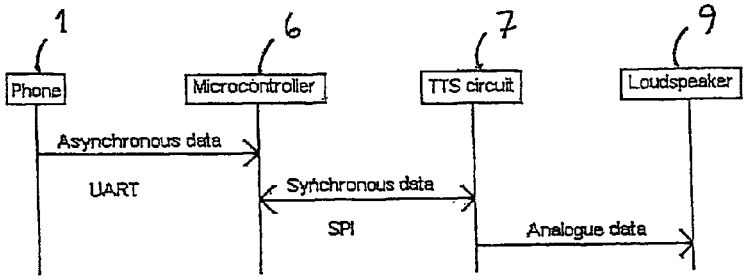
FIG. 3 is a data flow diagram.

FIG. 3 shows the data flow diagram between the blocks in the system. The different blocks need the right interfaces to communicate properly with each other. The interface between the phone 1 and the microcontroller 6 consists of a universal asynchronous receiver and transmitter UART, while the microcontroller 6 and the TTS circuit 7 communicate via a serial peripheral interface. The UART may form part of a commercial microcontroller.

FIG. 4 shows an example of the operation of the present invention. The mobile phone 1 includes a display 2 currently showing part of a message, e.g. an SMS. The keypad includes scroll buttons 3 for moving in the display. Currently one line 4 of the display is marked by highlighting the text. In an automatic mode, the control unit extracts one line or word after another at a fixed or adjustable rate and sends it automatically to the speech generating device for translating into spoken audio signals. It is preferably possible to pause, rewind and move fast forward in the text. The speed of the speech reading the text can be adjusted to suit each individual.

In another mode, the user scrolls in the display by means of the buttons 3 to select one line for sending to conversion circuit and reading aloud. The user may also select a whole text or a file, such as a message or downloaded article. The selected text is sent to the conversion circuit.

In a further mode, the text to speech conversion is active when the user is writing a message, such as an SMS. After inputting a letter or sign, this is read aloud. When a whole word is finished, e.g. as triggered by the input of a space, the word is sent to the conversion circuit and read aloud. Further, when a punctuation mark is input the whole last sentence may be read, and finally the whole message may be read before it is sent. The control unit sends the text to be read automatically in dependence of a definite set of characters, such as spaces and punctuation marks, and also, optionally, each input sign or letter.

The text-to-speech conversion in the phone is not only an aid for the visually impaired and car drivers but also a step further in personalising the phone. Some of the possibilities with the text-to-speech function in a mobile telephone are:

- Interaction with voice control. A voice command from the user can be used to control functions in the phone, like make a call or navigating in menus, and the speech function can then confirm the commands and possibly add help messages.
- Extended help functions, giving spoken explanations to a selected topic, like a step-by-step instruction on how to install an e-mail account. The whole instruction manual can be accessed in this way. This function can be activated and controlled by a shortcut or by voice recognition.
- By saving texts on memory sticks connectable to the device or the mobile phone, it is possible to have huge text masses like books read.
- Reading reminder and alerts from a calendar.
- Reading pages and articles downloaded from the Internet or by WAP.
- Use as a navigation aid together with GPS (Global Positioning System) and the Yellow Pages route service.

Different voices are possible. It is contemplated that popular voices like film stars etc. could be available for downloading or sold as connectable memory sticks. The spoken audio signal could also be combined with music files, e.g. MDI (Musical Instrument Digital Interface) files.

The invention may be implemented as a separate accessory connectable to an apparatus, or an apparatus incorporating such a device. The invention also relates to an apparatus connectable to such a device. The invention may be implemented by hardware or by software included in a self-contained apparatus or various combinations thereof. The scope of the invention is only limited by the claims below.

The invention claimed is:

1. An apparatus, comprising:

a display configured to display various readable data; and a control unit configured to extract a part of the displayed data and configured to send the extracted part of the displayed data to a speech generating device that is configured to generate a speech signal from the extracted part of the displayed data, wherein the speech generating device is an accessory device that is external to and physically attachable to the apparatus and is configured as a functional cover, and wherein the functional cover comprises:

a shell configured to cover at least a substantial portion of a front of the apparatus;

a microprocessor configured to communicate with the control unit of the apparatus; and an interface for physically attaching the speech generating device to the apparatus via a system connector.

2. An apparatus according to claim 1, wherein the control unit is configured to automatically send said extracted part of the displayed data to the speech generating device a line or a word at a time.

3. An apparatus according to claim 1, wherein the control unit is configured to send said extracted part of the displayed data to the speech generating device a line or a word at a time based on scrolling in the display.

4. An apparatus according to claim 1, wherein the displayed data includes text from menus, text messages, help information, calendars and/or confirmation of actions taken with the apparatus.

5. An apparatus according to claim 1, wherein the control unit is configured to send said extracted part of the displayed data to the speech generating device a line or a word at a time based on inputting characters to the apparatus via a keypad.

6. An apparatus according to claim 5, wherein the control unit is configured to send the part of the displayed data to the speech generating device responsive to input of spaces and/or punctuation marks via the keypad.

7. An apparatus according to claim 1, wherein the control unit is configured to extract the displayed data from a selected file and automatically send the displayed data to the speech generating device at a controllable rate.

8. An apparatus according to claim 1, wherein the data is received as ASCII characters.

9. An apparatus according to claim 1, wherein the speech generating device includes a conversion circuit configured to support various selectable languages.

10. An apparatus according to claim 9, wherein the conversion circuit is configured to download the languages via the connected apparatus.

11. An apparatus according to claim 1, wherein the speech generating device includes a conversion circuit configured to support various selectable voices.

12. An apparatus according to claim 11, wherein the conversion circuit is configured to download the voices via the connected apparatus.

13. An apparatus according to claim 1, wherein the speech generating device includes a microcontroller configured to be connected to a memory device containing language information including various languages, abbreviation lists and/or dictionaries.

14. An apparatus according to claim 1, wherein the speech generating device includes a microcontroller configured to be connected to a memory device containing voice settings.

15. An apparatus according to claim 1, wherein the apparatus comprises a portable telephone, a pager, a communicator and/or an electronic organizer, and wherein the display and the control unit are built into the apparatus.

16. An apparatus according to claim 1, wherein the control unit is configured to send the extracted part of the displayed data to the speech generating device at a controllable rate and in response to scrolling the displayed data.

17. An apparatus, comprising:

a display configured to display various readable data;

a control unit; and a speech generating device including a conversion circuit therein configured to convert received data to a speech signal and configured to be connected to a speaker system, wherein the control unit is configured to extract a part of the displayed data and send the extracted part of the displayed data to the speech generating device, and wherein the speech generating device is configured to provide a spoken reading of the displayed data at an adjustable rate, and wherein the speech signal comprises at least one word corresponding to a meaning of a short messaging system (SMS) icon included among the displayed data.

18. An apparatus according to claim 17, wherein the displayed data includes text from menus, text messages, help information, calendars and/or confirmation of actions taken with the apparatus.

19. An apparatus according to claim 17, wherein the control unit is configured to send said extracted part of the displayed data to the speech generating device based on inputting characters to the apparatus via a keypad.

20. An apparatus according to claim 19, wherein the control unit is configured to send the part of the displayed data to the speech generating device responsive to input of spaces and/or punctuation marks via the keypad.

21. An apparatus according to claim 17, wherein the control unit is configured to extract the displayed data from a selected file and automatically send the displayed data to the speech generating device at a controllable rate.

22. An apparatus according to claim 17, wherein the speaker system is integrated with the apparatus.

23. An apparatus according to claim 17, wherein the data is sent as ASCII characters.

24. An apparatus according to claim 17, wherein the conversion circuit is configured to support various selectable languages.

25. An apparatus according to claim 24, wherein the apparatus is configured to download the languages.

26. An apparatus according to claim 17, wherein the conversion circuit is configured to support various selectable voices.

27. An apparatus according to claim 26, wherein the apparatus is configured to download the voices.

28. An apparatus according to claim 17, wherein the apparatus is configured to be connected to a memory device containing language information including various languages, abbreviation lists and/or dictionaries.

29. An apparatus according to claim 17, wherein the apparatus is configured to be connected to a memory device containing voice settings.

30. A computer program product comprising a computer readable storage medium having computer readable program code embodied therein, the computer readable program code configured to be loaded into internal memory of an apparatus having a display for showing various readable data, the computer readable program code comprising:

computer readable program code configured to achieve the functionality of the apparatus of claim 17.

31. A mobile phone handset, comprising:

a display configured to display various readable data;

a speaker;

a speech generating device built into the mobile phone handset including a conversion circuit therein configured to convert received data to a speech signal and provide the speech signal to the speaker; and a control unit configured to extract a part of the displayed data and send the extracted part of the displayed data to the speech generating device, wherein the speech generating device is configured to provide a spoken reading of the displayed data at an adjustable rate, and wherein the speech signal comprises at least one word corresponding to a meaning of a short messaging system (SMS) icon included among the displayed data.

32. A mobile phone handset according to claim 31, wherein the control unit is configured to send the extracted part of the displayed data to the speech generating device at a controllable rate based on user interaction with the display comprising a voice control input.

33. A mobile phone handset according to claim 31, wherein the control unit is configured to send said extracted part of the displayed data to the speech generating device responsive to input of characters to the mobile phone handset.

34. A mobile phone handset according to claim 33, wherein the control unit is configured to send the part of the displayed data to the speech generating device responsive to input of spaces and/or punctuation marks via a keypad.

35. An apparatus according to claim 17, wherein the control unit is configured to send the extracted part of the displayed data to the speech generating device at a controllable rate and in response to scrolling the displayed data.

36. A mobile phone handset according to claim 31, wherein the control unit is configured to send the extracted part of the displayed data to the speech generating device at a controllable rate and in response to scrolling the displayed data.

* * * * *